US008493272B2

(12) United States Patent
Ollikainen et al.

(10) Patent No.: US 8,493,272 B2
(45) **Date of Patent: *Jul. 23, 2013**

(54) APPARATUS, METHOD AND COMPUTER PROGRAM FOR WIRELESS COMMUNICATION

(75) Inventors: Jani Ollikainen, Helsinki (FI); Harri A. Lasarov, Espoo (FI); Pekka Kilpi, Helsinki (FI); Jussi Rahola, Espoo (FI); Lassi Hyvonen, Helsinki (FI); Anssi Vanska, Helsinki (FI); Joonas Krogerus, Espoo (FI); Anping Zhao, Beijing (CN)

(73) Assignee: Nokia Corporation, Espoo (FI)

( * ) Notice: Subject to any disclaimer, the term of this patent is extended or adjusted under 35 U.S.C. 154(b) by 624 days.

This patent is subject to a terminal disclaimer.

(21) Appl. No.: 12/665,998

(22) PCT Filed: Jun. 23, 2008

(86) PCT No.: PCT/EP2008/057975

§ 371 (c)(1),
(2), (4) Date: Jun. 28, 2010

(87) PCT Pub. No.: WO2009/000815

PCT Pub. Date: Dec. 31, 2008

(65) Prior Publication Data

US 2010/0265148 A1 Oct. 21, 2010

(30) Foreign Application Priority Data

Jun. 22, 2007 (WO) ..... PCT/IB2007/002780

(51) Int. Cl.
*H01Q 9/04* (2006.01)

(52) U.S. Cl.
USPC ..... 343/749

(58) Field of Classification Search
USPC ..... 343/702, 895, 753, 844, 793
See application file for complete search history.

(56) References Cited

U.S. PATENT DOCUMENTS

| | | | | |
|---|---|---|---|---|
| 4,460,899 | A * | 7/1984 | Schmidt et al. | 343/841 |
| 5,952,978 | A * | 9/1999 | VanVoorhies | 343/742 |
| 6,259,407 | B1 * | 7/2001 | Tran | 343/700 MS |
| 6,469,675 | B1 * | 10/2002 | Jo et al. | 343/744 |

(Continued)

FOREIGN PATENT DOCUMENTS

| | | | |
|---|---|---|---|
| EP | 1 701 406 | A1 | 9/2006 |
| WO | WO 2005/074070 | A1 | 8/2005 |
| WO | WO 2006/031170 | A1 | 3/2006 |
| WO | WO 2007/043941 | A1 | 4/2007 |

OTHER PUBLICATIONS

Chiou, et al., "Designs of compact microstrip antennas with a slotted ground plane", IEEE, Ant. and Prop. Soc. Int. Symp. 2001 (IEEE AP-S 2001), vol. 2, Jul. 8-13, 2001 pp. 732-735.

(Continued)

*Primary Examiner* — Huedung Mancuso
(74) *Attorney, Agent, or Firm* — Harrington & Smith

(57) ABSTRACT

An apparatus including a radiator having an electrical length; a first conductive element; an interconnector, connected to the radiator and to the first conductive element, having a first configuration and a second configuration, wherein the radiator has a first electrical length when the interconnector is in the first configuration and a second electrical length, different to the first electrical length, when the interconnector is in the second configuration.

19 Claims, 7 Drawing Sheets

U.S. PATENT DOCUMENTS

| | | | | |
|---|---|---|---|---|
| 7,330,156 | B2 | 2/2008 | Arkko et al. | 343/702 |
| 7,439,935 | B1 * | 10/2008 | Rodenbeck | 343/895 |
| 8,134,506 | B2 * | 3/2012 | Leisten | 343/702 |
| 2002/0101298 | A1 | 8/2002 | Jinushi | 333/134 |
| 2002/0180651 | A1 * | 12/2002 | Hareyama | 343/702 |
| 2004/0051669 | A1 * | 3/2004 | Rutfors et al. | 343/702 |
| 2005/0110692 | A1 * | 5/2005 | Andersson | 343/702 |
| 2006/0097918 | A1 | 5/2006 | Oshiyama et al. | 343/700 |
| 2006/0109182 | A1 | 5/2006 | Rosenberg et al. | 343/702 |
| 2007/0115186 | A1 | 5/2007 | Vance | 343/702 |
| 2008/0150816 | A1 | 6/2008 | Rahola et al. | 343/720 |

OTHER PUBLICATIONS

P. Vainikainen, et al., "Resonator-based analysis of the combination of mobile handset antenna and chassis", IEEE Trans. on Antennas and Propagation, vol. 50, No. 10, pp. 1433-1444, Oct. 2002.

P. Kabacik, et al.,"An application of a narrow slot cut in the ground to improve multi-band operation of a small antenna", 2003 IEEE Topical conference on wireless technology, Hawaii, USA, Oct. 2003, (pp. 18-19).

P. Lindberg, et al., "A Bandwidth Enhancement Technique for Mobile Handset Antennas Using Wavetraps", IEEE Trans. on Ant. and Prop., vol. 54, No. 8, Aug. 2006, pp. 2226-2233.

W. Schroeder et al, "Extremely small, wideband mobile phone antenna by inductive chassis mode coupling," Proceedings of the 36th European Microwave Conference, pp. 1702-1705, 2006.

J. Holopainen et al., Mobile terminal antennas implemented by using direct coupling, Proceedings of the European Conference on Antennas and Propagations: EuCAP 2006, (6 pages).

P. Lindberg, et al., "Wideband slot antenna for low-profile hand-held terminal applications," The 36th European Microwave Conference 2006, pp. 1698-1701.

K. Wong et al., "Internal DTV antenna for folder-type mobile phone," Microwave and Optical Technology Letters, vol. 48, pp. 1015-1019, Jun. 2006.

* cited by examiner

APPARATUS, METHOD AND COMPUTER PROGRAM FOR WIRELESS COMMUNICATION

FIELD OF THE INVENTION

Embodiments of the present invention relate to an apparatus, method and computer program. In particular, they relate to an apparatus, method and computer program in a mobile cellular telephone.

BACKGROUND TO THE INVENTION

Within the field of electronic radio communication devices, there is a desire to reduce the overall size of such devices. Additionally, the reduction in size of electronic components recently has allowed the size of printed wiring board (PWBs) to be reduced.

Antenna arrangements for radio communication devices usually include unbalanced resonant antennas which require a ground plane to operate. In most devices, the printed wiring board acts as the ground plane for the antenna elements. If the largest dimension of the ground plane is of the order of $\lambda/2$ or a multiple of $\lambda/2$ (where $\lambda$ is equal to the operating wavelength), the ground plane can also support radiating resonant modes of its own. At radio communication frequency bands (850 MHz for example), miniaturization of antenna elements can be achieved by using the antenna elements not only as radiators but also to excite resonant modes of the ground plane which then radiates a significant portion of the signal from the device.

In order to maximise the operational bandwidth of a relatively small antenna element on a portable radio communication device, resonant frequencies of the resonant modes of the antenna and the ground plane should be substantially equal and there should be relatively strong coupling between the resonant modes. The lowest order mode of the ground plane resonates when its largest dimension (usually the length) is equal to $\lambda/2$. Antenna elements can affect the electrical length of the ground plane, making it either electrically longer or shorter than the physical length of the ground plane. Further ground plane resonances occur when the electrical length of the ground plane is a multiple of $\lambda/2$. The optimal ground plane lengths (or other dimensions) for different frequencies can be found using characteristic mode analysis, for example.

The electrical length is the length of a current path expressed in terms of the wavelength. The electrical length may be related to the physical length of the ground plane for longitudinal resonant modes or the width of the ground plane for transverse resonance modes. The electrical length need not be equal to any of the physical dimensions, as for example meandering or adding discrete components change the electrical length. In addition, adding a slot in the ground plane makes the electrical length longer as the current path is a combination of transverse and longitudinal components. A device will usually have multiple electrical lengths as different antennas generate different current distributions and resonance modes at the various operating frequencies.

As the size of the printed wiring board is reduced (below 100 mm for example), the performance of the antenna arrangement may be worsened due to the printed wiring board having an electrical length which is too short for the desired operational frequency band. Consequently, it may be difficult to achieve reasonable antenna performance in a relatively small device.

It would therefore be desirable to provide an alternative apparatus.

BRIEF DESCRIPTION OF VARIOUS EMBODIMENTS OF THE INVENTION

According to various, but not necessarily all, embodiments of the invention there is provided an apparatus comprising: a radiator having an electrical length; a first conductive element; an interconnector, connected to the radiator and to the first conductive element, having a first configuration and a second configuration, wherein the radiator has a first electrical length when the interconnector is in the first configuration and a second electrical length, different to the first electrical length, when the interconnector is in the second configuration.

The radiator may be connected to a feed line and may be configured to receive electrical energy from the feed line. The radiator may comprise a first portion and a second separate portion. The feed line may be connected to the first portion and to the second portion. The interconnector may include a switch for switching the interconnector between the first configuration and the second configuration. The interconnector may include a frequency selective element which is arranged to configure the interconnector into the first configuration and into the second configuration.

The radiator may include a ground plane and the apparatus may further comprise an antenna positioned for coupling with the ground plane.

When the interconnector is in the first configuration, the interconnector may connect the ground plane to the first conductive element, and when the interconnector is in the second configuration, the interconnector may disconnect the first conductive element from the ground plane.

The apparatus may comprise a second conductive element, and when the interconnector is in the first configuration, the interconnector may connect the ground plane to the first conductive element, and when the interconnector is in the second configuration, the interconnector may connect the ground plane to the second conductive element.

The interconnector may include a switch for switching the interconnector between the first configuration and the second configuration.

The interconnector may include a frequency selective element which may be arranged to configure the interconnector into the first configuration and into the second configuration in dependence on the frequency band of a signal input to the interconnector.

The apparatus may comprise a third conductive element and a further interconnector connected to the first conductive element and to the third conductive element. The further interconnector may have a first configuration and a second configuration, wherein the ground plane may have a third electrical length when the interconnector is in the first configuration and a fourth electrical length when the interconnector is in the second configuration.

The further interconnector may include a switch for switching the further interconnector between the first configuration and the second configuration.

The further interconnector may include a frequency selective element which may be arranged to configure the further interconnector into the first configuration and into the second configuration in dependence on the frequency band of a signal input to the further interconnector.

The antenna may be positioned on the ground plane. The antenna may be positioned on the first conductive element.

A conductive element may be a component of the apparatus that provides a function in addition to changing the electrical length of the radiator. A conductive element may only be provided for changing the electrical length of the radiator.

The apparatus may further comprise a decoupling capacitor, connected to the radiator and to an interconnector for inhibiting the flow of DC or low frequency current therethrough.

The apparatus may further comprise an RF choke for inhibiting the flow of RF signals in the apparatus. The apparatus may further comprise a further conductive element directly connected to a conductive element for changing the electrical length of the conductive element. Changing the configuration of an interconnector may change the current distribution in the apparatus.

The apparatus may further comprise a frequency selective electromagnetic bandgap structure connected to the radiator which is arranged to prevent the radiator from resonating at a predetermined frequency band. The electrical length of the radiator may be related to the physical length of the radiator.

The radiator may have a further electrical length and the further electrical length may have a first value when the interconnector is in the first configuration and a second value when the interconnector is in the second configuration. The further electrical length of the radiator may be related to the physical width of the radiator.

According to various, but not necessarily all, embodiments of the invention there is provided a portable electronic device comprising an apparatus as described in the preceding paragraphs.

According to various, but not necessarily all, embodiments of the invention there is provided a module comprising an apparatus as described in the preceding paragraphs.

According to various, but not necessarily all, embodiments of the invention there is provided a method comprising: providing a radiator having an electrical length, a first conductive element; an interconnector, connected to the radiator and to the first conductive element, having a first configuration and a second configuration, arranging the radiator such that the radiator has a first electrical length when the interconnector is in the first configuration and a second electrical length, different to the first electrical length, when the interconnector is in the second configuration.

The method may further comprise connecting the radiator to a feed line, wherein the radiator may be configured to receive electrical energy from the feed line.

The radiator may include a ground plane and the method may further comprise providing an antenna positioned for coupling with the ground plane.

When the interconnector is in the first configuration, the interconnector may connect the radiator to the first conductive element, and when the interconnector is in the second configuration, the interconnector may disconnect the first conductive element from the radiator.

The method may comprise providing a second conductive element, and when the interconnector is in the first configuration, the interconnector may connect the radiator to the first conductive element, and when the interconnector is in the second configuration, the interconnector may connect the radiator to the second conductive element.

The method may further comprise controlling the interconnector to switch between the first configuration and the second configuration.

According to various, but not necessarily all, embodiments of the invention there is provided a computer-readable storage medium encoded with instructions that, when executed by a processor, perform: controlling an interconnector, connected to a radiator and to a first conductive element, to provide the radiator with a first electrical length when the interconnector is in a first configuration and a second electrical length, different to the first electrical length, when the interconnector is in a second configuration.

The computer-readable storage medium may be encoded with instructions that, when executed by a processor, perform: detecting if the radiator requires a change in electrical length and controlling the interconnector in response to the detection.

According to various, but not necessarily all, embodiments of the invention there is provided a computer program that, when run on a computer, performs: controlling an interconnector, connected to a radiator and to a first conductive element, to provide the radiator with a first electrical length when the interconnector is in a first configuration and a second electrical length, different to the first electrical length, when the interconnector is in a second configuration.

The computer program, when run on a computer, may perform: detecting if the radiator requires a change in electrical length and controlling the interconnector in response to the detection.

BRIEF DESCRIPTION OF THE DRAWINGS

For a better understanding of various embodiments of the present invention reference will now be made by way of example only to the accompanying drawings in which.

DETAILED DESCRIPTION OF VARIOUS EMBODIMENTS OF THE INVENTION

The figures illustrate an apparatus 10 comprising: a radiator 30 having an electrical length; a conductive element 15, 16, 18, 20, 22, 24, 38, 42, 44, 48, 66, 70; an interconnector 32, 46, 64 connected to the radiator 30 and to the conductive element, having a first configuration and a second configuration, wherein the radiator 30 has a first electrical length when the interconnector is in the first configuration and a second electrical length, different to the first electrical length, when the interconnector is in the second configuration.

Figure 1:
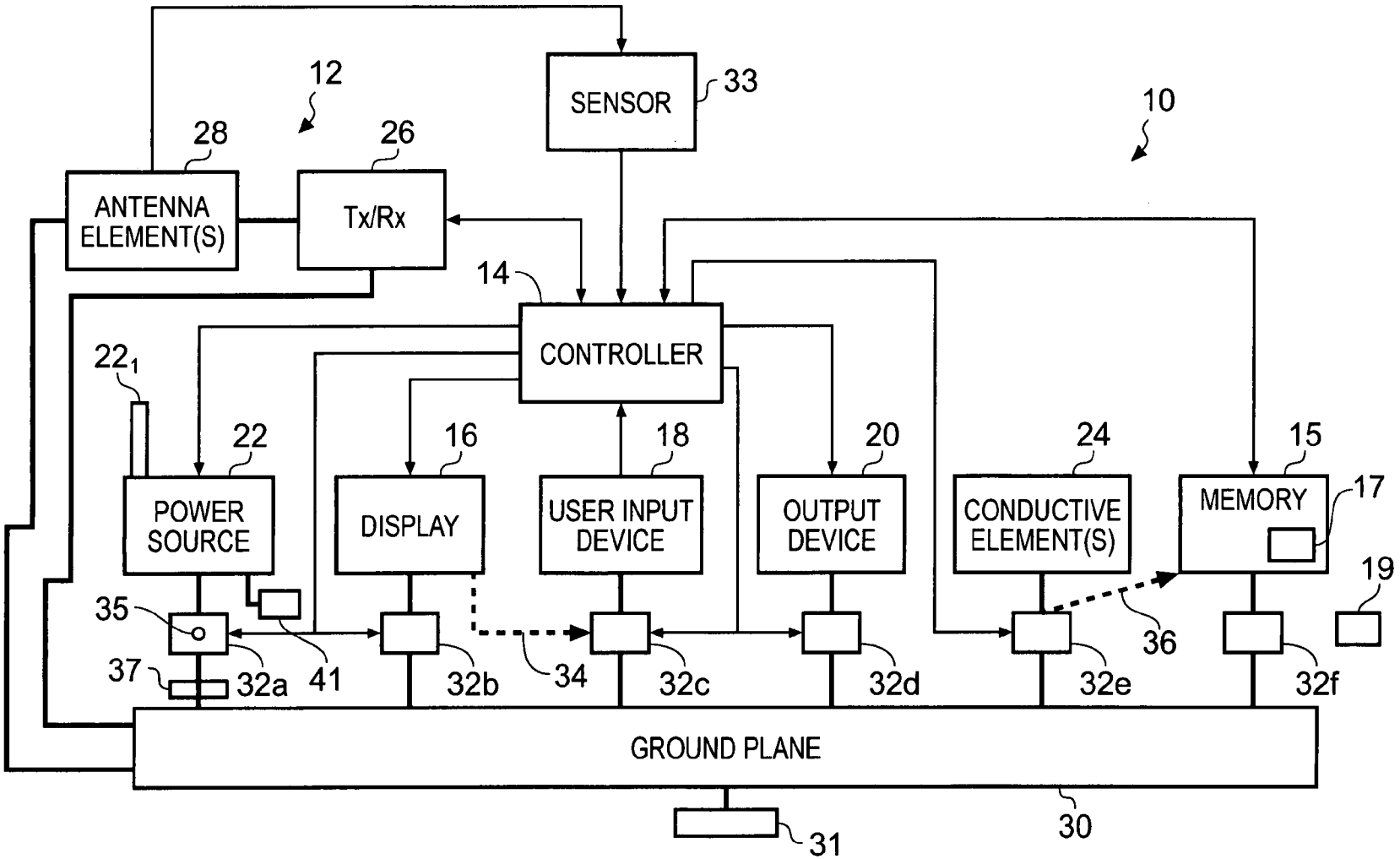
FIG. 1 illustrates a schematic diagram of an apparatus including an antenna arrangement according to various embodiment of the invention.

FIG. 1 illustrates a schematic diagram of an apparatus 10 including an antenna arrangement 12 according to various embodiments of the invention. In more detail, the apparatus 10 includes a controller 14, a memory 15, a display 16, a user input device 18, an output device 20, a power source 22, optional conductive element(s) 24, a transceiver 26, one or more antenna elements 28, a radiator 30, interconnectors 32*a*, 32*b*, 32*c*, 32*d*, 32*e*, 32*f* and optionally a sensor 33.

In the following description, the wording 'connect' and 'couple' and their derivatives mean operationally connected/coupled. It should be appreciated that any number or combination of intervening components can exist (including no intervening elements). Additionally, it should be appreciated that the connection/coupling may be a physical galvanic connection and/or an electromagnetic connection.

Additionally, in the following description it should be appreciated that where an antenna is mentioned as being operable in a resonant frequency band, it should be understood to mean that the antenna is operable in a frequency band over which the antenna can efficiently operate. Efficient operation occurs, for example, when the antenna's insertion loss S11 is greater than an operational threshold such as 4 dB or 6 dB.

In FIG. 1, thin lines are used to represent control/data lines between the controller 14 and a component of the apparatus 10. Thick lines are used to represent electrical (RF short circuit) connections between the ground plane 30 and a conductive element of the apparatus 10.

The apparatus 10 may be any radio communication electronic device. In particular, the apparatus 10 may be a portable radio communication device such as a mobile cellular telephone, a personal digital assistant (PDA) or other portable radio communication device.

The controller 14 may be any suitable processor and may be a microprocessor for example. The controller 14 may be a discrete, separate component, or may be integrated in an interconnector. The implementation of the controller 14 can be in hardware alone (e.g. a circuit, a processor . . . ), have certain aspects in software including firmware alone or can be a combination of hardware and software (including firmware).

The controller 14 may be implemented using instructions that enable hardware functionality, for example, by using executable computer program instructions in a general-purpose or special-purpose processor that may be stored on a computer readable storage medium (e.g. disk, memory etc) to be executed by such a processor.

The controller 14 is connected to read from and write to the memory 15. The controller 14 may also comprise an output interface via which data and/or commands are output by the controller 14 and an input interface via which data and/or commands are input to the controller 14. The memory 15 may be any suitable memory and may be, for example, permanent built in memory such as flash memory or may be a removable memory such as a hard disk, secure digital (DS) card or a micro-drive.

The memory 15 stores a computer program 17 comprising computer program instructions that control the operation of the apparatus 10 when loaded into the controller 14. The computer program instructions 17 provide the logic and routines that enables the apparatus 10 to perform the method illustrated in FIG. 7. The controller 14 by reading the memory 15 is able to load and execute the computer program 17.

The computer program 17 may arrive at the apparatus 10 via any suitable delivery mechanism 19. The delivery mechanism 19 may be, for example, a computer-readable storage medium, a computer program product, a memory device, a record medium such as a CD-ROM or DVD, an article of manufacture that tangibly embodies the computer program 17. The delivery mechanism 19 may be a signal configured to reliably transfer the computer program 17. The apparatus 10 may propagate or transmit the computer program 17 as a computer data signal.

Although the memory 15 is illustrated as a single component it may be implemented as one or more separate components, some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The display 16 is coupled to the controller 14 for receiving and displaying data. The controller 14 may read data from the memory 15 and provide it to the display 16 for display to a user of the mobile cellular telephone 10. The controller 14 may be arranged to control a graphical user interface on the display 16. The display 16 may be any suitable display and may be for example, a thin film transistor (TFT) display or a liquid crystal display (LCD).

The controller 14 is connected to read signals from the user input device 18. The user input device 18 may be any device by which the user can interact with the apparatus 10. For example, the user input device 18 may be a microphone, a keypad, a joystick or any other suitable device.

The controller 14 is connected to the output device 20 to convey information to the user. For example, the output device 20 may be an audio speaker which is arranged to provide information to the user aurally or a second display.

The power source 22 may be any source of electrical power that is suitable for powering the apparatus 10. For example, in a mobile cellular telephone the power source 22 may be one or more batteries. The power source 22 is arranged to provide electrical power to each of the components of the apparatus (e.g. the controller 14, the memory 15, the display 16 etc. . . . ) but its connections for this purpose are not illustrated in order to maintain the clarity of FIG. 1.

As mentioned above, the apparatus 10 also includes conductive element(s) 24. The conductive elements 24 include any element or device which has a part which is electrically conductive. For example, the conductive elements 24 may include (and are not limited to) printed wiring boards (PWBs), RF shields, metal foils, flexible PWBs, covers, metallic coatings, conductive mechanically stiffening elements, metal frames surrounding other elements such as displays, cable assemblies, flexible interconnection lines, hinges, sockets, reactive components such as capacitors and inductors, and vibration mechanisms for vibrating the apparatus 10. The conductive elements 24 are optional in some embodiments and will be discussed in greater in the following paragraphs.

The electrical conductivity of the elements can be obtained by using, for example, fully metallic parts, parts with metallic coatings, parts with conductive ink, parts with conductive plastic and conductive liquids and gases.

The conductive elements mentioned above may be connected to one another and to the radiator 30 in different ways. For example, galvanic connections can be made through screws, pogo pins, conductive strips, flexes, springs etc. . . . . The conductive elements may be galvanically connected at one or multiple locations (e.g. at corners) and mechanically connected but electrically isolated at other locations. In order to achieve electrical isolation, metal screws may be used which have isolating plastic parts adjacent them. Alternatively, the screws may be non-conductive.

The transceiver 26 is connected to the one or more antenna elements 28, the controller 14 and to the ground plane 30. The one or more antenna elements 28 may, in some embodiments, be connected to the ground plane 30. The controller 14 is arranged to provide data to the transceiver 26. The transceiver 26 is arranged to encode the data and provide it to the one or more antenna elements 28 for transmission. The one or more antenna elements 28 are arranged to transmit the encoded data as a radio signal.

The one or more antenna elements 28 are also arranged to receive a radio signal. The one or more antenna elements 28 then provide the received radio signal to the transceiver 26 which decodes the radio signal into data. The transceiver 26 then provides the data to the controller 14.

The one or more antenna elements 28 may be any antenna elements which are suitable for radio communication. For example, in the embodiment where the apparatus 10 is a mobile cellular telephone, the one or more antenna elements 28 may include (but are not limited to) planar inverted F antennas (PIFAs), inverted F antennas (IFAs), whip antennas, loop antennas, helix antennas, monopole antennas, slot antennas, notch antennas and dielectric resonator antennas (DRAs). It should be appreciated that the one or more antenna elements may include any combination of the above antenna types.

The antenna arrangement 12 is arranged to operate in a plurality of different operational radio frequency bands and via a plurality of different protocols. In various embodiments, the antenna arrangement 12 includes a plurality of antenna elements which may operate according to different protocols (multiradio device) or the same protocol (diversity/MIMO). For example, the different frequency bands and protocols may include (but are not limited to) DVB-H 470 to 750 MHz, US-GSM 850 (824-894 MHz); EGSM 900 (880-960 MHz); GPS 1572.42 MHz, PCN/DCS1800 (1710-1880 MHz); US-WCDMA1900 (1850-1990) band; WCDMA21000 band (Tx: 1920-19801 Rx: 2110-2180); PCS1900 (1850-1990 MHz); 2.5 GHz WLAN/BT, 5 GHz WLAN, DRM (0.15-30.0 MHz), FM (76-108 MHz), AM (0.535-1.705 MHz), DVB-H [US] (1670-1675 MHz), WiMax (2300-2400 MHz, 2305-2360 MHz, 2496-2690 MHz, 3300-3400 MHz, 3400-3800 MHz, 5150-5875 MHz), RFID (LF [125-134 kHz], HF[13.56 MHz]) UHF [433 MHz, 865-956 MHz or 2.45 GHz), and UWB 3.0 to 10.6 GHz. Consequently, each of the one or more antenna elements 28 may have different electrical lengths in order to achieve these frequencies and protocols.

The radiator 30 is an electrically conductive member which is arranged to couple with the one or more antenna elements 28. In various embodiments of the invention, the radiator 30 includes a ground plane which may be a printed wiring board (PWB) on which the components of the apparatus (e.g. the power source 22, display 16 etc. . . . ) and the one or more antenna elements 28 are mounted. In other embodiments of the invention, the ground plane 30 on which the one or more antenna elements 28 are mounted may be a different conductive element and may be, for example, the key pad of a mobile cellular telephone.

One or more electrical lengths of the ground plane 30 (for example, related to the physical length and/or physical width) may be changed using various techniques. For example, to increase the electrical length of the ground plane 30, slots may be cut in the ground plane to give it a meandering shape and/or conductive strips (straight, bent or meandering) may be connected to the ground plane 30. In order to decrease the electrical length of the ground plane 30, the ground plane 30 may be connected to discrete components which tune the ground plane or to wave traps. These techniques may also be applied to any of the conductive elements in order to ensure that they have desired electrical lengths. In particular, the conductive casing of any of the conductive elements mentioned above can be meandered or shaped in such a way that one or more of the electrical lengths of the conductive element changes.

In some embodiments, the ground plane 30 may be connected to a frequency selective electromagnetic bandgap structure 31. The bandgap structure 31 is a periodic metallic structure which may be placed on top of, and connected to the ground plane 30. The bandgap structure 31 inhibits the flow of current over a frequency range and may be used to prevent the ground plane 30 from resonating at a predetermined frequency band.

The ground plane 30 is connected to the power source 22, display 16, user input device 18, output device 20, conductive element(s) 24 and memory 15 via interconnectors 32*a*, 32*b*, 32*c*, 32*d*, 32*e*, 32*f* respectively.

The connections between the ground plane 30 and the conductive elements may include decoupling capacitors 37 which inhibit the flow of DC or low frequency current but allow the propagation of RF signals. In FIG. 1, a decoupling capacitor 37 is illustrated and is connected to the ground plane 30 and to the interconnector 32*a*. With a decoupling capacitor, the interconnectors 32 can be used to tune the electrical lengths of the ground plane without interfering with the operation of the components.

In various embodiments, one or more RF chokes 41 may be provided to inhibit the flow of RF signals in the apparatus 10. For example, an RF choke 41 may be connected to the power terminals of the power source 22 to prevent RF signals from flowing in the power supply circuitry of the apparatus.

The power source 22, display 16, user input device 18, output device 20 and memory 15 each comprise a portion which is electrically conductive and can therefore be considered conductive elements. For example, the power source 22 may have a casing which is metallic and may therefore be electrically conductive. The ground plane 30 is connected to the conductive portion of a conductive element via an interconnector. It should be appreciated that a conductive element may have a function (such as providing electrical power) in addition to connecting to an interconnector and for being arranged to change one or more electrical lengths of the ground plane. It should also be appreciated that a conductive element may only be provided to connect to an interconnector and change one or more electrical lengths of the ground plane (e.g. as in the case of a metal foil).

A further conductive element may be directly connected to a conductive element to change the one or more of the electrical lengths of the conductive element. For example, in FIG. 1, the power source 22 is connected to a conductive element (conductive strip $\mathbf{22}_1$) which changes the electrical length of the power source 22. The conductive strip $\mathbf{22}_1$ may have any shape and may be straight, bent or meandering.

In various embodiments of the invention, the antenna arrangement 12 is non-planar. The ground plane 30 may be a printed wiring board which defines a plane and the conductive elements may be positioned outside of this plane. For example, the keypad of a mobile cellular phone is a conductive element which is usually positioned above the printed wiring board.

In various embodiments of the invention, the conductive elements 22, 26, 18, 20, 24, 15 may be connected to one another via an interconnector. For example, in FIG. 1 the display 16 is connected to the user input device 18 via interconnector 32*c* (via the connection represented by dotted line 34).

Furthermore, in various embodiments of the invention, an interconnector may be connected to more than one conductive element. For example, the interconnector 32*e* may be connected to the conductive elements 24 and to the memory 15 (via the connection represented by dotted line 36).

In embodiments of the invention, the interconnector 32*a*, 32*b*, 32*c*, 32*d*, 32*e*, 32*f* have at least a first configuration and a second configuration and are used to provide the apparatus 10 with a reconfigurable ground plane.

When an interconnector is in the first configuration, the interconnector may electrically connect the ground plane to a first conductive element and thereby change one or more electrical lengths of the ground plane 30 (e.g. related to the physical width and/or physical length of the ground plane). Consequently, the resonant frequency band of the ground plane 30 may also be changed.

When an interconnector is in the second configuration, the interconnector may disconnect the ground plane 30 from the first conductive element so that the one or more electrical lengths of the ground plane 30 are unaltered from their original electrical lengths. Alternatively, the interconnector may connect the ground plane 30 to a second, different, conductive element and thereby change the one or more electrical lengths (and resonant frequency bands) of the ground plane 30.

The interconnectors 32*a* to 32*f* may include a switch for electrically connecting and disconnecting a conductive element to the ground plane and which may be controlled by the controller 14. The switch may be a MEMS switch, a CMOS switch, a GaAs switch, a pin-diode switch, a mechanical switch or any other suitable switch.

An interconnector which includes a mechanical switch may make a connection or break the connection when the user of the device changes the configuration of the device. For example if the device is a portable radio telephone, the mechanical switch may change configuration when a fold mechanism (see FIG. 5) is opened and closed or when a slide mechanism (see FIG. 4) is opened and closed. Additionally, if the telephone is a rotatable terminal, the switch may change configuration when the telephone is rotated.

An interconnector may also include an electrically or mechanically controlled variable reactance (e.g. a varactor) or resistance. These control components may be implemented using any suitable high-frequency or RF technology such as semiconductors, MEMS, BST (Barium Strontium Titanate).

Alternatively (or in addition), the interconnectors 32*a* to 32*f* may include a frequency selective element (e.g. interconnector 32*a* includes frequency selective element 35) which only allows the ground plane 30 to electrically connect with a conductive element if the frequency of an input signal is above or below a predetermined threshold frequency. For example, if the frequency selective element is a low pass filter, the interconnector will allow the ground plane and a conductive element to connect when the frequency of an input signal is below a predetermined threshold frequency and will not allow them to connect when the frequency of an input signal is above the predetermined threshold frequency. The frequency selective element may be a SAW/BAW filter, a MEMS filter or an LC filter (with a tuning capacitor). It should be appreciated that different combinations of switches and frequency selective elements may be used for an interconnector.

In various embodiments, the apparatus 10 includes a sensor 33 which is arranged to measure the impedance of the one or more antenna elements 28 and provide this information to the controller 14. The controller 14 is arranged to read this information and control the interconnectors accordingly so as to provide the one or more antenna elements 28 with desired impedances.

Embodiments of the present invention provide an advantage in that they allow the one or more electrical lengths of the ground plane 30 to be altered and may consequently optimise antenna performance for a given operational frequency band, apparatus position and/or arrangement. The electrical lengths and hence resonant frequencies of the ground plane 30 can be changed to more closely match the operating frequencies of the antenna elements.

Embodiments of the present invention also provide a further advantage in that they can also be used to control the current distribution at different frequencies. By controlling the current distribution, the input impedances, near fields, isolation and radiation patterns of the one or more antennas can be changed. Consequently, embodiments of the present invention can be used to reduce the near fields at a part of the apparatus 10, increase the isolation between the antennas and/or control the radiation pattern.

In one embodiment the antenna arrangement 12 may include a first antenna element which is arranged to operate in a first operational frequency band and a second antenna element which is arranged to operate in a second, different operational frequency band. The electrical length (in this embodiment, related to the physical length) of the ground plane may be changed in order to optimise the performance of the first antenna element when it is operational and changed in order to optimise the performance of the second antenna element when it is operational. For example, if the first operational frequency band is US-GSM850 and the second operational frequency band is US-WCDMA1900, an interconnector may connect the ground plane 30 to a conductive element when the first antenna element is operational in order to increase the electrical length (and hence decrease the resonant frequency of the ground plane to US-GSM850) of the ground plane, and disconnect the ground plane 30 from the conductive element when the second antenna element is operational in order to decrease the electrical length (and hence increase the resonant frequency of the ground plane to US-WCDMA1900).

Additionally, the electrical length of the ground plane 30 can be altered in order to take into account different positions (e.g. next to the user's cheek whilst making a phone call) and arrangements (e.g. for slide and fold phones) of the apparatus 10 which may affect an antennas performance.

Embodiments of the invention provide another advantage in that they may allow the size of a printed wiring board of an apparatus to be reduced. Since the printed wiring board usually acts as the ground plane for antenna elements, its size may be reduced since its electrical lengths may be changed by connecting it to different conductive elements.

Figure 2:
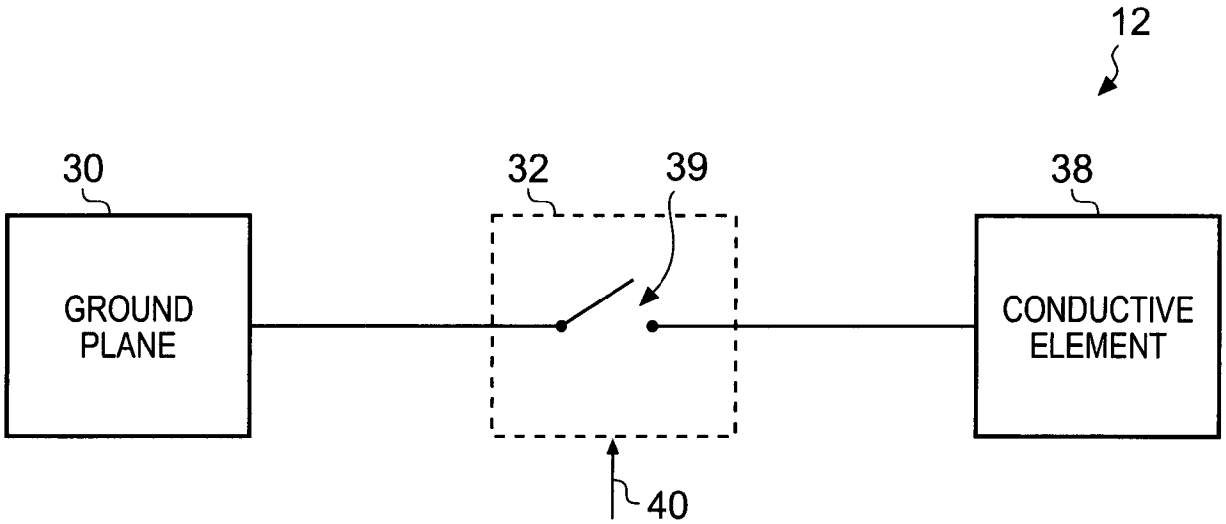
FIG. 2 illustrates a schematic diagram of a part of an antenna arrangement according to a first embodiment of the invention.

FIG. 2 illustrates a schematic diagram of a part of an antenna arrangement 12 according to a first embodiment of the invention. In this embodiment, the ground plane 30 is connected to a conductive element 38 via an interconnector 32. The interconnector 32 comprises a switch 39 which is controlled by a signal 40 from the controller 14 (illustrated in FIG. 1). The electrical length of the ground plane 30 may be changed by controlling the switch 39 to switch between electrically connecting the ground plane 30 to the conductive element 38 and disconnecting the ground plane 30 from the conductive element 38.

For example, if the conductive element 38 includes an inductor in series, the electrical length of the ground plane 30 may be lengthened when the ground plane 30 is connected to the inductor. If the conductive element 38 includes a capacitor in series, the electrical length of the ground plane 30 may be shortened when the ground plane 30 is connected to the capacitor. The electrical length of the ground plane 30 may also be shortened for a given radio frequency by connecting the ground plane 30 to a high impedance surface (such as a $\lambda/4$ transmission line). A high impedance surface may be formed by arranging the conductive elements in a suitable way or by connecting additional mechanical strips to any of the conductive elements. Such an arrangement may also make the ground plane electrically longer for other radio frequencies.

Figure 3:
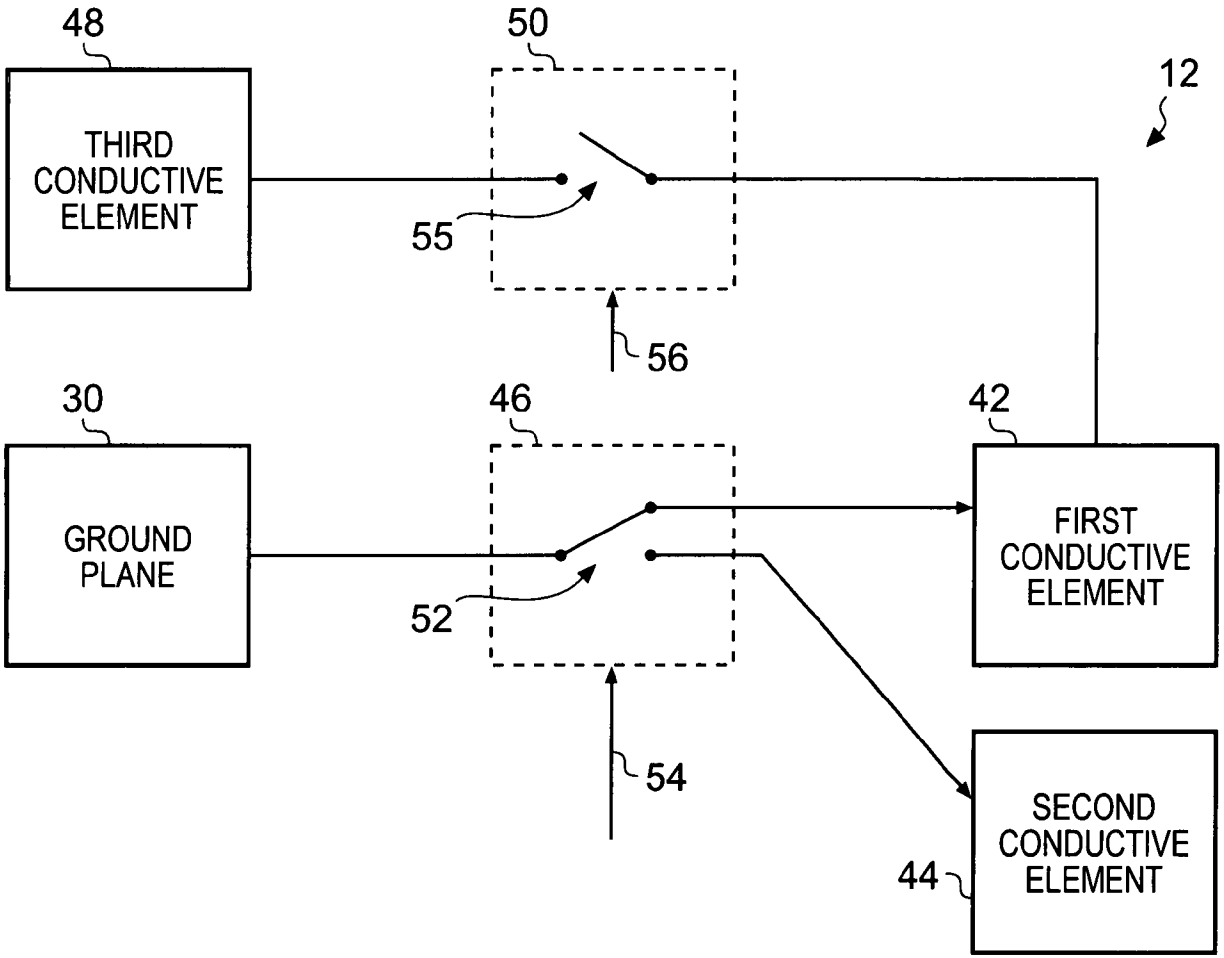
FIG. 3 illustrates a schematic diagram of a part of an antenna arrangement according to a second embodiment of the invention.

FIG. 3 illustrates a schematic diagram of a part of an antenna arrangement 12 according to a second embodiment of the invention. In this embodiment, the ground plane 30 is connected to a first conductive element 42 and a second conductive element 44 via a first interconnector 46. Additionally, the ground plane 30 is connected to a third conductive element 48 via the first interconnector, first conductive element 42 and second interconnector 50.

The interconnector 46 comprises a switch 52 which is controlled by a signal 54 from the controller 14. The electrical length of the ground plane 30 may be changed by controlling the switch 52 to switch between electrically connecting the ground plane 30 to the first conductive element 42 and connecting the ground plane 30 to the second conductive element 44.

If the switch 52 connects the ground plane 30 to the first conductive element 42, the ground plane 30 may also be connected to the third conductive element 48 to once again change the electrical length of the ground plane 30. The second interconnector 50 includes a switch 55 which may be controlled by the controller 14 via signal 56 to switch between connecting the first conductive element 42 to the third conductive element 48 and disconnecting the first conductive element 42 from the third conductive element 48.

An example will now be described to show to the reader how the embodiment illustrated in FIG. 3 may be used to enable the ground plane 30 to operate at three different resonant modes, low band (e.g. US-GSM 850), medium band (e.g. GPS 1572 MHz) and high band (e.g. US-WCDMA1900). In this embodiment, the first, second and third conductive elements each have an electrical length of their own. The first conductive element 42 has an electrical length which is longer than that of the second conductive element 44.

If the antenna arrangement 12 is to operate in the high band, the controller 14 controls the switch 52 to connect the ground plane 30 to the second conductive element 44 and thereby provide the ground plane 30 with a relatively short electrical length and relatively high resonant frequency.

If the antenna arrangement 12 is to operate in the medium band, the controller 14 controls the switch 52 to connect the ground plane 30 to the first conductive element 42 and the switch 55 to disconnect the first conductive element from the third conductive element and thereby provide the ground plane 30 with an electrical length which is longer than when the antenna arrangement 12 is operating in the high band. This electrical length allows the ground plane 30 to resonate in the medium band.

If the antenna arrangement 12 is to operate in the low band, the controller 14 controls the switch 52 to connect the ground plane 30 to the first conductive element 42. The controller 14 also controls the switch 55 to connect the first conductive element 42 to the third conductive element 48. By connecting the ground plane 30 to the first conductive element 42 and to the third conductive element 48, the electrical length of the ground plane 30 is increased so that it is longer than the electrical lengths of the ground plane 30 for the high and medium band. This electrical length allows the ground plane 30 to resonate in the low band.

From the above description, one can understand how the electrical length of the ground plane 30 can be changed so that it may resonate in three different radio frequency bands. It should be appreciated that the above is just an example. Alternatively or in addition, another electrical length (such as those related to the physical width of the ground plane) of the ground plane can be changed. This can also be used for achieving an optimal combination of longitudinal and transversal resonance modes of the ground plane, for a single frequency band or for multiple frequency bands simultaneously. Therefore, embodiments of the present invention provide an advantage in that the electrical lengths of the ground plane 30 can be changed so that the ground plane 30 may resonate in a plurality of operational frequency bands.

Figure 4:
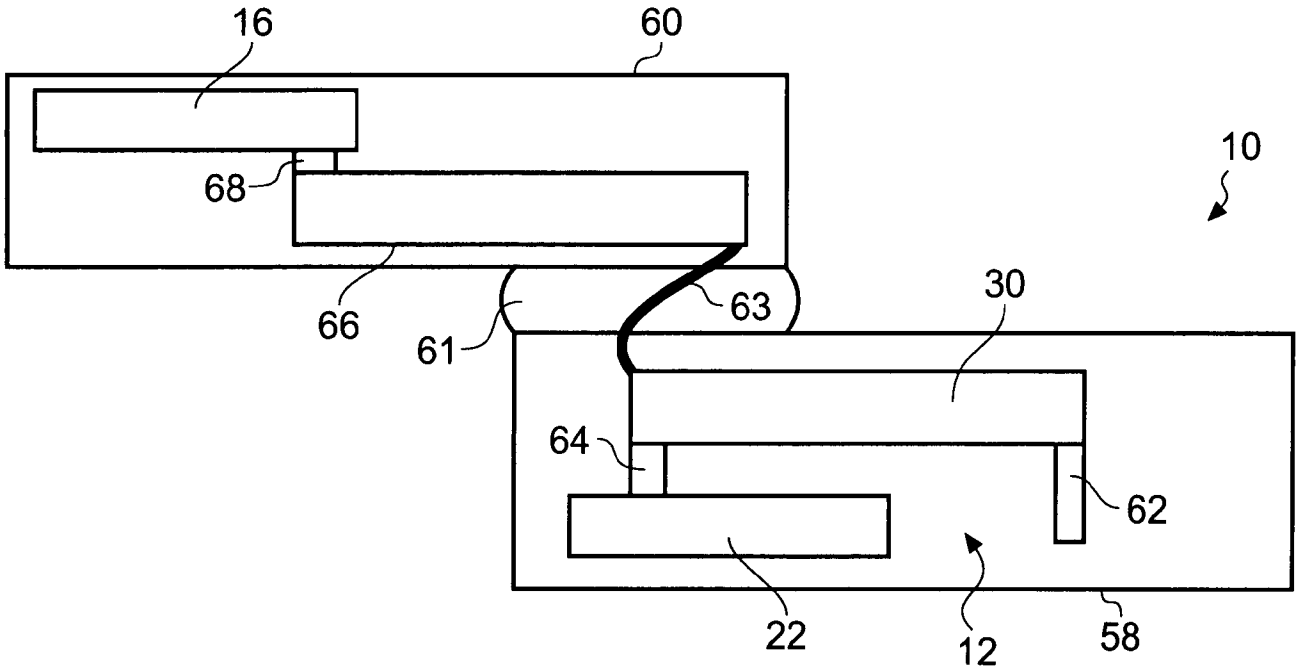
FIG. 4 illustrates a schematic side view of a mobile cellular telephone incorporating a slide mechanism according to one embodiment of the invention.

FIG. 4 illustrates a schematic side view of a mobile cellular telephone 10 incorporating a slide mechanism 61 according to one embodiment of the invention. The mobile cellular telephone comprises a first housing 58 and a second housing 60 which are connected to one another via the slide mechanism 61. The first housing 58 houses the ground plane 30 (which is a PWB in this embodiment) on which is mounted an antenna element 62, an interconnector 64 and a power source 22 which is connected to the ground plane 30 via the interconnector 64. The second housing 60 comprises a printed wiring board 66 on which is mounted an interconnector 68. A display 16 is connected to the printed wiring board 66 via the interconnector 66. The ground plane 30 and the printed wiring board 66 are connected to one another via an electrical cable 63. Slide telephones are well known within the art and the operation of the slide mechanism will not be discussed in detail here.

The electrical lengths of the ground plane 30 may be altered by electrically connecting it to the power source 22, printed wiring board 66 and display 16.

Figure 5:
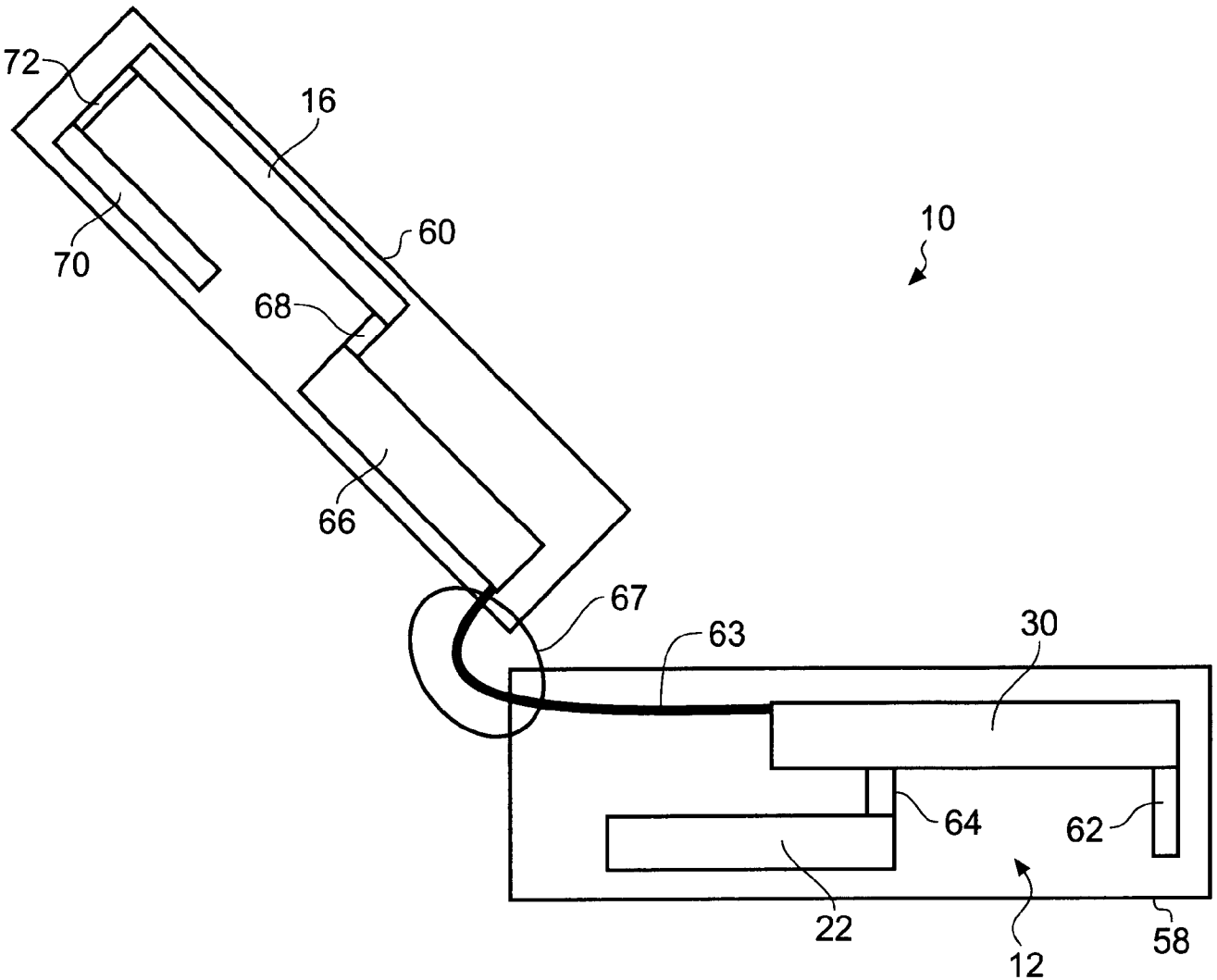
FIG. 5 illustrates a schematic side view of a mobile cellular telephone incorporating a folding mechanism according to one embodiment of the invention.

FIG. 5 illustrates a schematic side view of a mobile cellular telephone 10 incorporating a fold mechanism 67 according to one embodiment of the invention. The mobile cellular telephone illustrated in FIG. 5 is similar to the mobile cellular telephone in FIG. 4 and where the features are similar, the same reference numerals are used. The mobile cellular telephone comprises a first housing 58 and a second housing 60 which are connected to one another via the fold mechanism 67 (which may be a hinge for example). The first housing 58 houses the ground plane 30 (which is a PWB in this embodiment) on which is mounted an antenna element 62, an interconnector 64 and a power source 22 which is connected to the ground plane 30 via the interconnector 64. The second housing 60 comprises a printed wiring board 66 on which is mounted an interconnector 68. A display 16 is connected to the printed wiring board 66 via the interconnector 66 and a second display 70 is connected to the display 16 via an interconnector 72. The ground plane 30 and the printed wiring board 66 are connected to one another via an electrical cable 63.

The electrical lengths of the ground plane 30 may be altered by electrically connecting it to the power source 22, printed wiring board 66, display 16 and second display 70.

Embodiments of the present invention provide an advantage for slide and fold mobile cellular telephones 10 in that they enable the electrical lengths of the ground plane 30 to be extended when the phone is placed in its closed configuration (i.e. when the two housings 58 and 60 abut one another) and thereby improve antenna performance. In one embodiment, the controller 14 is arranged to determine when the phone is open or closed and control the interconnectors 64, 68 and 72 accordingly. Alternatively, a mechanical device may be provided for selecting the configuration of the interconnectors in dependence on the configuration of the phone (i.e. whether it is open or closed).

Figure 6:
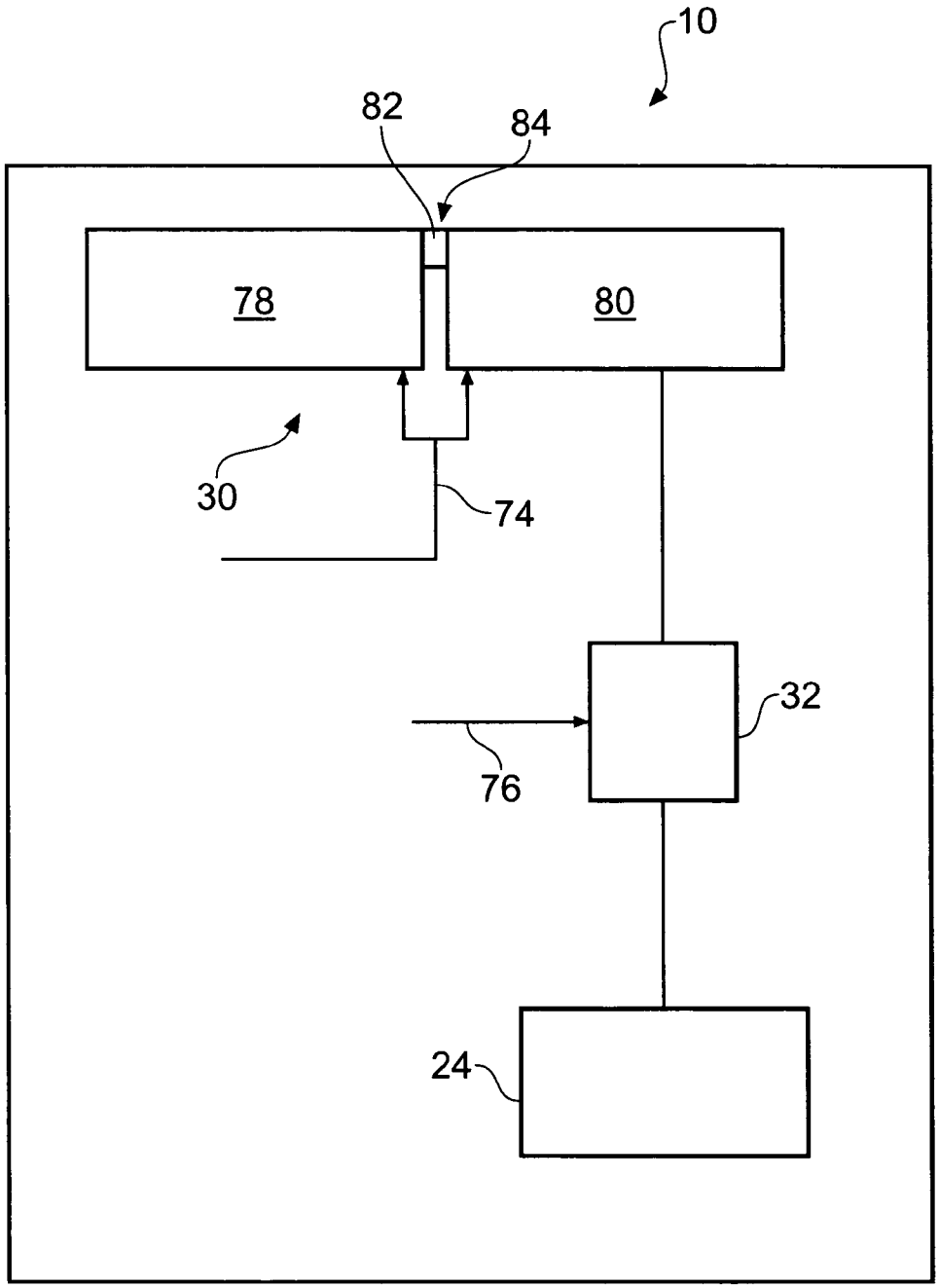
FIG. 6 illustrates a schematic diagram of an apparatus according to various embodiments of the invention.

FIG. 6 illustrates a schematic diagram of an apparatus 10 according to various embodiments of the present invention. The apparatus 10 illustrated in FIG. 6 is similar to the apparatus 10 illustrated in FIGS. 1 to 5 and where the features are similar, the same reference numerals are used.

The apparatus 10 of FIG. 6 differs from the apparatus illustrated in FIGS. 1 to 5 in that it does not include a dedicated antenna (e.g. such as antenna elements 28 illustrated in FIG. 1) for coupling with the radiator 30 (e.g. there is no dedicated antenna mounted on the radiator 30). Instead, the apparatus 10 of FIG. 6 includes a radiator 30 which is connected to the transceiver 26 (not illustrated in FIG. 6) via a feed line 74 (i.e. the radiator 30 is directly electrically fed). The radiator 30 may be any suitable conductive element and may be for example, a printed wiring board (PWB), an RF shield, a metal foil, a flexible PWB, a cover for the apparatus or for an internal component of the apparatus, a metallic coating, a conductive mechanically stiffening element, a metal frame surrounding other elements such as displays, a cable assembly, a flexible interconnection line, a hinge, a socket, a reactive component such as a capacitor or an inductor, and a vibration mechanism for vibrating the apparatus 10. From the above list, it should be appreciated that the radiator 30 is not a dedicated antenna and may be an existing component of the apparatus 10.

The radiator 30 is configured to efficiently receive electromagnetic signals and provide them to the transceiver 26 for decoding. Similarly, the radiator 30 is configured to receive encoded signals from the transceiver 26 and efficiently transmit them as electromagnetic signals.

The radiator 30 is connected to a conductive element 24 via an interconnector 32. The conductive member 24 may be any conductive member of the apparatus 10 and may be one or more of those described above. The interconnector 32 may be any suitable interconnector and may be any one or more of those described above. The interconnector 32 may be configured to receive a control signal 76 from the controller 14 which controls the configuration of the interconnector 72 as described above.

In this embodiment, the radiator 30 comprises a first portion 78 and a second separate portion 80 which are both configured to receive the feed line 74 and may form a dipole antenna. As described above, the electrical length of the radiator 30 may be controlled by changing the configuration of the interconnector 32. In various embodiments, the first portion 78 and the second portion 80 may be connected to one another by an interconnector 82 which is arranged to receive a control signal 82 from the controller 14. As with the interconnector 32, by changing the electrical length of the interconnector 82, the controller 14 may select a suitable electrical length for the radiator 30.

The embodiment illustrated in FIG. 6 may provide an advantage in that by removing at least some of the dedicated antenna(s) from the apparatus 10 and by using the radiator 30 as an antenna, the apparatus 10 may be made smaller and/or be able to house additional electronic components.

Figure 7:
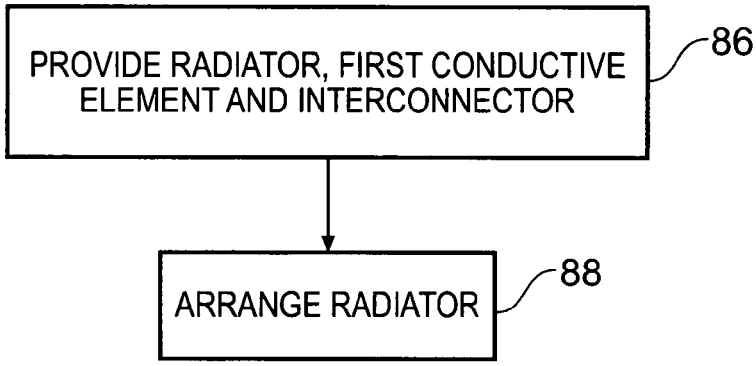
FIG. 7 illustrates a flow diagram of a method of manufacturing an apparatus according to various embodiments of the invention.

FIG. 7 illustrates a flow diagram of a method of manufacturing an apparatus 10 according to various embodiments of the invention. At block 86, a radiator 30, a first conductive element 24 and an interconnector 32 are provided and connected to one another. In the embodiments where the radiator is directly fed, block 86 may also include connecting the radiator to a feed line (the radiator is configured to receive electrical energy from the feed line). In the embodiments where the apparatus includes dedicated antennas, block 86 includes providing an antenna and positioning it for coupling with the ground plane. In block 88, the radiator 30 is arranged so that the radiator 30 has a first electrical length when the interconnector 32 is in the first configuration and a second electrical length, different to the first electrical length, when the interconnector 32 is in the second configuration.

Figure 8:
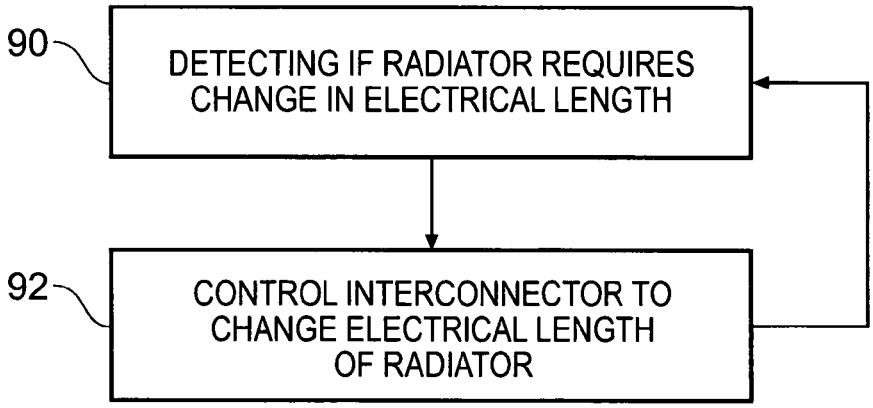
FIG. 8 illustrates a flow diagram of a method of controlling an interconnector according to various embodiments of the invention.

FIG. 8 illustrates a flow diagram of a method of controlling an interconnector according to various embodiments of the invention. At block 90, the method includes detecting if the radiator requires a change in electrical length, For example, the controller 14 may detect that the apparatus 10 has changed operating mode (e.g. from text messaging mode to phone call mode) and determine that a change in the electrical length of the radiator 30 is required for efficient reception/transmission. At block 90, the method includes controlling the interconnector 30 to change configuration and thereby change the electrical length of the radiator 30. For example, the controller 14 may send a control signal to the interconnector and thereby change its configuration, as instructed in the control signal. The method then returns to block 90.

The blocks illustrated in the FIG. 8 may represent steps in a method and/or sections of code in the computer program 17. The illustration of a particular order to the blocks does not necessarily imply that there is a required or preferred order for the blocks and the order and arrangement of the block may be varied. Furthermore, it may be possible for some steps to be omitted.

Although functions have been described with reference to certain features, those functions may be performable by other features whether described or not.

Although features have been described with reference to certain embodiments, those features may also be present in other embodiments whether described or not.

Although embodiments of the present invention have been described in the preceding paragraphs with reference to various examples, it should be appreciated that modifications to the examples given can be made without departing from the scope of the invention as claimed. For example, it should be appreciated that the apparatus 10 may include a plurality of conductive elements, a plurality of interconnectors and a plurality of antenna elements which may be arranged to enable the antenna arrangement to operate in a plurality of different radio frequency bands and protocols and that embodiments of the invention are not limited to the examples described above.

Features described in the preceding description may be used in combinations other than the combinations explicitly described.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a radiator having an electrical length;

a first conductive element;

an interconnector, connected between the radiator and the first conductive element, having a first configuration and a second configuration, wherein the radiator has a first electrical length when the interconnector is in the first configuration and a second electrical length, different to the first electrical length, when the interconnector is in the second configuration, wherein the first conductive element is a component of the apparatus configured to provide a function in addition to changing the electrical length of the radiator.

2. An apparatus as claimed in claim 1, wherein the radiator is connected to a feed line and is configured to receive electrical energy from the feed line.

3. An apparatus as claimed in claim 2, wherein the radiator comprises a first portion and a second, separate portion, the feed line being connected to the first portion and to the second portion.

4. An apparatus as claimed in claim 1, wherein the interconnector includes a switch for switching the interconnector between the first configuration and the second configuration.

5. An apparatus as claimed in claim 1, wherein the interconnector includes frequency selective element which is arranged to configure the interconnector into the first configuration and into the second configuration.

6. An apparatus as claimed in claim 1, wherein the radiator includes a ground plane and the apparatus further comprises an antenna positioned for coupling with the ground plane.

7. An apparatus as claimed in claim 6, wherein when the interconnector is in the first configuration, the interconnector connects the ground plane to the first conductive element, and when the interconnector is in the second configuration, the interconnector disconnects the first conductive element from the ground plane or the apparatus further comprises a second conductive element, and when the interconnector is in the first configuration, the interconnector connects the ground plane to the first conductive element, and when the interconnector is in the second configuration, the interconnector connects the ground plane to the second conductive element.

8. An apparatus as claimed in claim 6, comprising a third conductive element and a further interconnector connected to the first conductive element and to the third conductive element, the further interconnector has a first configuration and a second configuration, wherein the ground plane has a third electrical length when the interconnector is in the first configuration and a fourth electrical length when the interconnector is in the second configuration.

9. An apparatus as claimed in claim 6, wherein the antenna is positioned on the ground plane or is positioned on the first conductive element.

10. An apparatus as claimed in claim 1, wherein the radiator has a further electrical length and the further electrical length has a first value when the interconnector is in the first configuration and a second value when the interconnector is in the second configuration.

11. A portable electronic device or a module comprising an apparatus as claimed in claim 1.

12. A method comprising:

providing a radiator having an electrical length, a first conductive element; an interconnector, connected between the radiator and the first conductive element, having a first configuration and a second configuration, arranging the radiator such that the radiator has a first electrical length when the interconnector is in the first configuration and a second electrical length, different to the first electrical length, when the interconnector is in the second configuration, wherein the first conductive element is a component of the apparatus configured to provide a function in addition to changing the electrical length of the radiator.

13. A method as claimed claim 12, further comprising connecting the radiator to a feed line, wherein the radiator is configured to receive electrical energy from the feed line.

14. A method as claimed in claim 12, wherein the radiator includes a ground plane and the method further comprises providing an antenna positioned for coupling with the ground plane.

15. A method as claimed in claim 12, wherein when the interconnector is in the first configuration, the interconnector connects the radiator to the first conductive element, and when the interconnector is in the second configuration, the interconnector disconnects the first conductive element from the radiator.

16. A method as claimed in, claim 12, comprising providing a second conductive element, and when the interconnector is in the first configuration, the interconnector connects the radiator to the first conductive element, and when the interconnector is in the second configuration, the interconnector connects the radiator to the second conductive element.

17. A method as claimed in claim 12, further comprising controlling the interconnector to switch between the first configuration and the second configuration.

18. A non-transitory computer-readable storage medium encoded with instructions that, when executed by a processor, perform: controlling an interconnector, connected between a radiator and a first conductive element, to provide the radiator with a first electrical length when the interconnector is in a first configuration and a second electrical length, different to the first electrical length, when the interconnector is in a second configuration, wherein the first conductive element is a component of an apparatus configured to provide a function in addition to changing the electrical length of the radiator.

19. A non-transitory computer-readable storage medium as claim in claim 18, encoded with instructions that, when executed by a processor, perform: detecting if the radiator requires a change in electrical length and controlling the interconnector in response to the detection.

* * * * *

UNITED STATES PATENT AND TRADEMARK OFFICE

CERTIFICATE OF CORRECTION

PATENT NO. : 8,493,272 B2
APPLICATION NO. : 12/665998
DATED : July 23, 2013
INVENTOR(S) : Jani Ollikainen et al.

It is certified that error appears in the above-identified patent and that said Letters Patent is hereby corrected as shown below:

In the Claims

In Claim 13:
Column 16, line 18, "claimed claim" should be deleted and --claimed in claim-- should be inserted.

In Claim 16:
Column 16, line 32, "claimed in, claim" should be deleted and --claimed in claim-- should be inserted.

Signed and Sealed this
Seventeenth Day of September, 2013

Teresa Stanek Rea
*Deputy Director of the United States Patent and Trademark Office*